US010424238B2

(12) United States Patent
Yang et al.

(10) Patent No.: US 10,424,238 B2
(45) Date of Patent: Sep. 24, 2019

(54) DISPLAY DEVICE

(71) Applicant: SAMSUNG DISPLAY CO., LTD., Yongin-si, Gyeonggi-do (KR)

(72) Inventors: Seohyeong Yang, Incheon (KR); Seokyun Son, Suwon-si (KR); Kyung-uk Choi, Gunpo-si (KR)

(73) Assignee: Samsung Display Co., Ltd., Yongin-Si, Gyeonggi-do (KR)

( * ) Notice: Subject to any disclaimer, the term of this patent is extended or adjusted under 35 U.S.C. 154(b) by 164 days.

(21) Appl. No.: 15/491,470

(22) Filed: Apr. 19, 2017

(65) Prior Publication Data

US 2017/0309221 A1 Oct. 26, 2017

(30) Foreign Application Priority Data

Apr. 21, 2016 (KR) ..... 10-2016-0048869

(51) Int. Cl.
*G09G 3/20* (2006.01)

(52) U.S. Cl.
CPC ..... *G09G 3/2096* (2013.01); *G09G 2310/08* (2013.01)

(58) Field of Classification Search
CPC .. G09G 5/003; G09G 3/2092; G09G 2370/04; G09G 2370/22
USPC ..... 345/204
See application file for complete search history.

(56) References Cited

U.S. PATENT DOCUMENTS 8,928,907 B2 1/2015 Min et al.
2010/0073384 A1* 3/2010 Kim ..... G09G 3/2096 345/520
2011/0249015 A1* 10/2011 Lonkar ..... G06F 3/1431 345/589
2015/0077926 A1* 3/2015 Schneider ..... G06F 1/1632 361/679.41
2016/0323620 A1 11/2016 Kim et al.
2017/0193971 A1* 7/2017 Bi ..... G09G 5/39
2018/0239718 A1* 8/2018 Jabori ..... G06F 13/4295

FOREIGN PATENT DOCUMENTS

EP 3089165 A1 * 11/2016 ..... H04N 19/423
JP 5290473 B2 9/2013
KR 10-0469507 1/2005
KR 10-2013-0127468 11/2013
KR 10-2015-0113158 10/2015
KR 10-2015-0127319 11/2015

* cited by examiner

*Primary Examiner* — Mark Edwards
(74) *Attorney, Agent, or Firm* — Lee & Morse, P.C.

(57) ABSTRACT

A display device includes a timing controller and a display. The timing controller is connected to a connector of a USB cable and receive image signals from a host through the USB cable. The display receives the image signals from the timing controller to display an image. The timing controller includes an interface controller, a control signal selector, a data transmitter, and a data processor. The interface controller outputs control signals to control an output order of the image signals. The control signal selector selects and outputs a control signal corresponding to a connection position of the connector from the interface controller. The data transmitter determines the output order of the image signals from the host based on the control signal from the control signal selector. The data processor receives the image signal from the data transmitter and provides the image signal to the display.

19 Claims, 7 Drawing Sheets

DISPLAY DEVICE

CROSS-REFERENCE TO RELATED APPLICATION

Korean Patent Application No. 10-2016-0048869, filed on Apr. 21, 2016, and entitled, "Display Device," is incorporated by reference herein in its entirety.

BACKGROUND

1. Field

One or more embodiments described herein relate to a display device.

2. Description of the Related Art

A display device may operate based on control and image signals from a host. The display device may be a monitor and the host may be a personal computer which includes a graphics card or processing unit for the control and image signals. The host and display device are connected through a cable having connectors at respective ends.

SUMMARY

In accordance with one or more embodiments, a display device includes a timing controller, connected to a connector of a USB cable, to receive image signals from a host through the USB cable; and a display to receive the image signals from the timing controller to display an image, wherein the timing controller includes: an interface controller to output control signals to control an output order of the image signals; a control signal selector to select and output a control signal corresponding to a connection position of the connector among the control signals from the interface controller; a data transmitter to determine the output order of the image signals from the host based on the control signal from the control signal selector; and a data processor to receive the image signal from the data transmitter and to provide the received image signal to the display.

The interface controller may receive an operation voltage from the host through the USB cable. The connector may be connected to the timing controller in a first position or a reverse position, and the reverse position may be an upside-down state of the connector. The image signals may be provided to the data transmitter in different orders based on whether the connector is connected to the timing controller in the first position or the reverse position.

The control signals may include a first control signal to control an output operation of the data transmitter when the connector is connected to the timing controller in the first position; and a second control signal to control an output operation of the data transmitter when the connector is connected to the timing controller in the reverse position.

The control signal selector may output the first control signal when the connector is connected to the timing controller in the first position, and the second control signal when the connector is connected to the timing controller in the reverse position. The control signal selector may receive connector connection information from the host, and output one of the first or second control signals based on the connector connection information received according to a connection position of the connector.

The data transmitter may output the image signals in an order in which the image signals are received based on the first control signal. The data transmitter may change an output order of the image signals equal to when the connector is connected to the timing controller in the first position based on the second control signal.

The timing controller may receive a main control signal to control an operation timing of the display from the host through the USB cable, and control the display to display the image based on the main control signal. The timing controller may include a timing control signal generator to generate a data control signal and a gate control signal to control an operation timing of the display based on the main control signal and to provide the data control signal and the gate control signal to the display, wherein the data transmitter is to receive the main control signal from the host through the USB cable and provide the received main control signal to the timing control signal generator.

The display may include a display panel includes a plurality of pixels to emit light to display the image; a gate driver to generate gate signals based on the gate control signal from the timing control signal generator and to provide the gate signals to the pixels; and a data driver to receive the image signals from the data processor, generate data voltages corresponding to the image signals based on the data control signal from the timing control signal generator, and provide the data voltages to the pixels, wherein the data processor is to receive the image signal from the data transmitter, convert the image signal to match an interface specification of the data driver, and provide the converted image signal to the data driver.

The timing controller may include a first storage area to store specification information corresponding to the display panel. The data transmitter may provide the specification information of the display panel stored in the first storage area to the host through the USB cable, and the host is to provide image signals and a main control signal corresponding to the specification information of the display panel to the data transmitter through the USB cable.

The display device may include a DC/DC converter to receive an input voltage to generate and output a plurality of voltages to operate the display, wherein the interface controller is to receive the input voltage from the host through the USB cable and provide the received input voltage to the DC/DC converter.

The timing controller may include a scaler to output a screen control signal to adjust at least one of a brightness, color, size, or position of a display area where the image is displayed, the data transmitter is to receive the screen control signal and provide the screen control signal to the host through the USB cable, and the host is to provide image signals and a main control signal to adjust at least one of the brightness, color, size, or position of the display area to the data transmitter through the USB cable based on the screen control signal.

The scaler may include a second storage area to store pop-up data to display at least one of the brightness, color, size, or position of the display area, and when a user changes at least one of the brightness, color, size, or position of the display area, the display is to receive the pop-up data from the second storage area and display the received pop-up data.

In accordance with one or more other embodiments, an apparatus includes at least one signal line; and a controller connected to the at least one signal line, wherein the controller is to generate a control signal based on a position of a connector, the control signal to indicate a first output order of image signals for the display based on a first position of the connector and to indicate a second output order of the image signals based on a second position of the connector different from the first position. The second position may be a reverse of the first position. The at least one signal line may be between the connector and the display.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
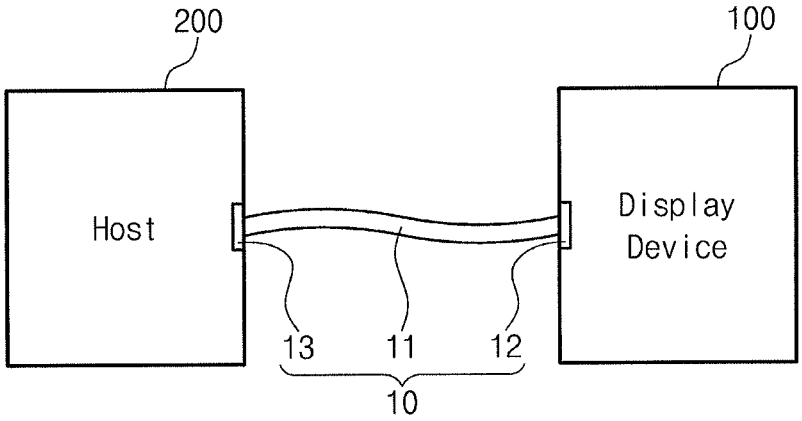
FIG. 1 illustrates an embodiment of a display device.

Example embodiments are described with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments (or portions thereof) may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

Figure 2A:
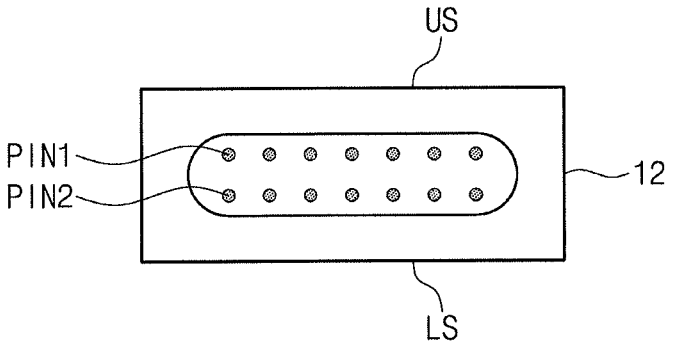
FIGS. 2A and 2B illustrate an embodiment of a first connector.
Figure 2B:
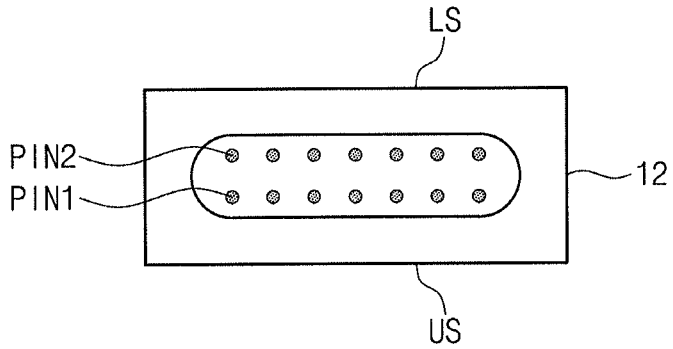

FIG. 1 illustrates an embodiment of a connection 10 between a display device 100 and a host 200, and FIGS. 2A and 2B illustrate of different views of the front of an embodiment of a first connector in FIG. 1. Referring to FIGS. 1, 2A, and 2B, the connection may be, for example, a USB cable, the display device 100 may be a monitor, and the host 200 may be a computer. In one embodiment, the USB cable 10 may be a USB 3.1 type C cable, but may be a different cable in another embodiment. The USB cable 10 includes a cable 11, a first connector 12 connected to one end of the cable 11, and a second connector 13 at the other end of the cable 11. The first connector 12 is connected to the display device 100. The second connector 13 is connected to host 200.

Referring to FIGS. 2A and 2B, the first connector 12 includes a plurality of first pins PIN1 and a plurality of second pins PIN2. The first pins PIN1 may be arranged in one direction and adjacent to the top surface US of the first connector 12. The second pins PIN2 may be arranged in one direction and adjacent to the lower surface LS of the first connector 12 opposite to the upper surface US of the first connector 12. In FIGS. 2A and 2B, the one direction is a horizontal direction, and the upper surface US and the lower surface LS of the first connector 12 are set with reference to a vertical direction.

The first connector 12 may be connected to the display device 100 regardless of the arrangement position of the first connector 12. For example, the number of the first pins PIN1 and the number of the second pins PIN2 may be the same. When viewed in a vertical direction, the first pins PIN1 and the second pins PIN2 overlap each other.

When the first connector 12 is at a first position, the upper surface US of the first connector 12 faces upward and the lower surface LS of the first connector 12 faces downward. Accordingly, when the first connector 12 is at the first position, the first pins PIN1 are above the second pins PIN2. When the first connector 12 is turned upside down and in a reverse position, the upper surface US of the first connector 12 faces downward and the lower surface LS of the first connector 12 faces upward. When the first connector 12 is in a reverse position, the first pins PIN1 are therefore below the second pins PIN2.

The form of the first connector 12 in which the first pins PIN1 and the second pins PIN2 are therefore the same regardless of position. The terminal of the display device 100 to be connected to the first connector 12 may also have a form corresponding to the first connector 12. Therefore, the first connector 12 may be connected to the display device 100 without distinguishing between the first and reverse positions.

The host 200 provides various signals through the USB cable 10. In one embodiment, the signals include a voltage for operating the display device 100, a main control signal for controlling operation of the display device 100, and image signals. The host 200 may include a graphics card (or graphics processing unit (GPU)) for providing the control signal and image signals to the display device 100, and a power supply unit for supplying power to the display device 100.

The display device 100 may operate based on the voltage supplied through the USB cable 10. The display device 100 may display an image corresponding to the image signals based on the main control signal provided through the USB cable 10.

The order of transmission order of data to the display device 100 through the USB cable 10 may be different depending on the position of the first connector 12, e.g., whether the first connector 12 is in the first or reverse positions. The display device 100 may change the image signals received through the first connector 12 when the first connector 12 is in the reverse position, in order to match the order of image signals when the image signals are received through the first connector 12 in the first position.

Figure 3:
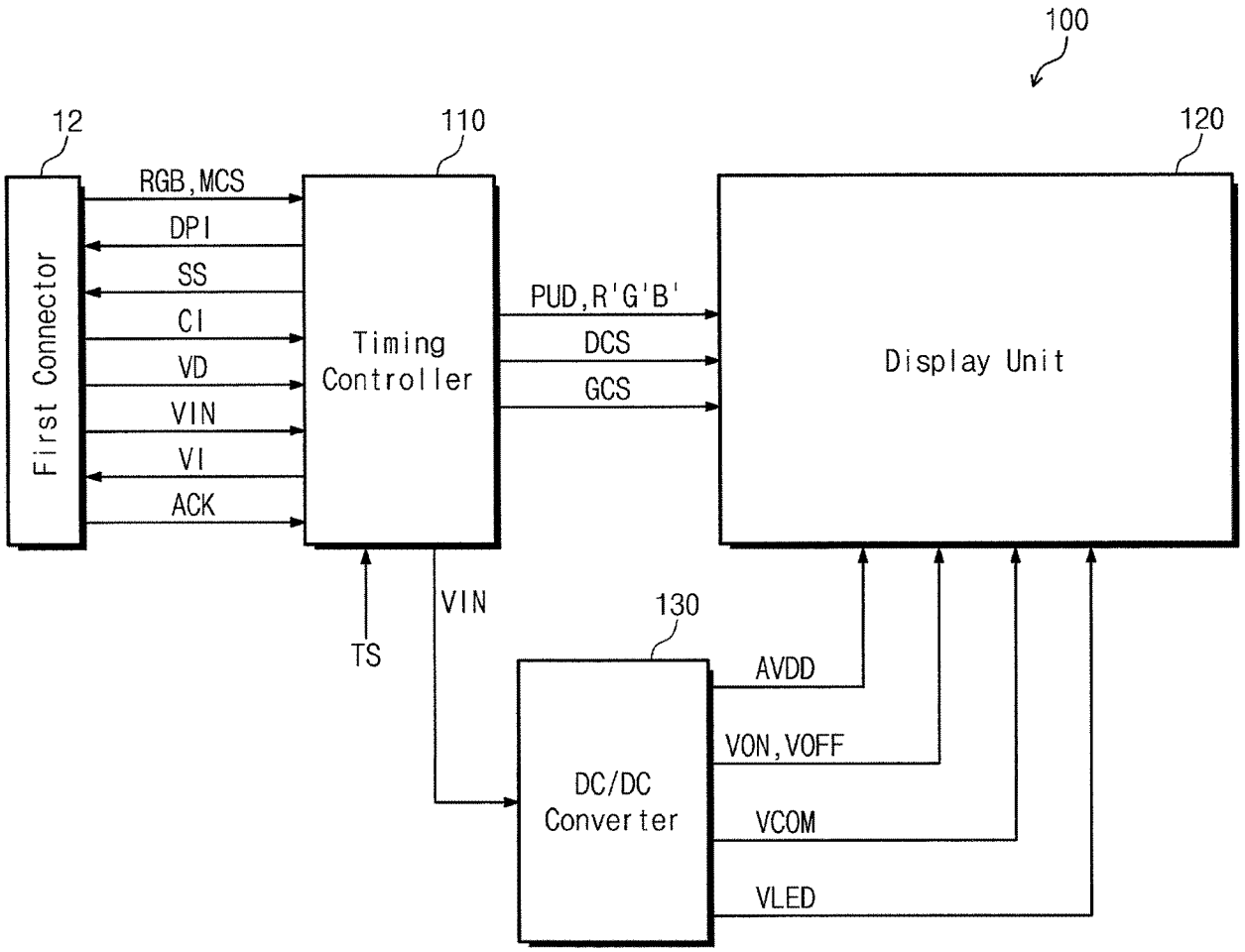
FIG. 3 illustrates an embodiment of the display device in FIG. 1.
Figure 4:
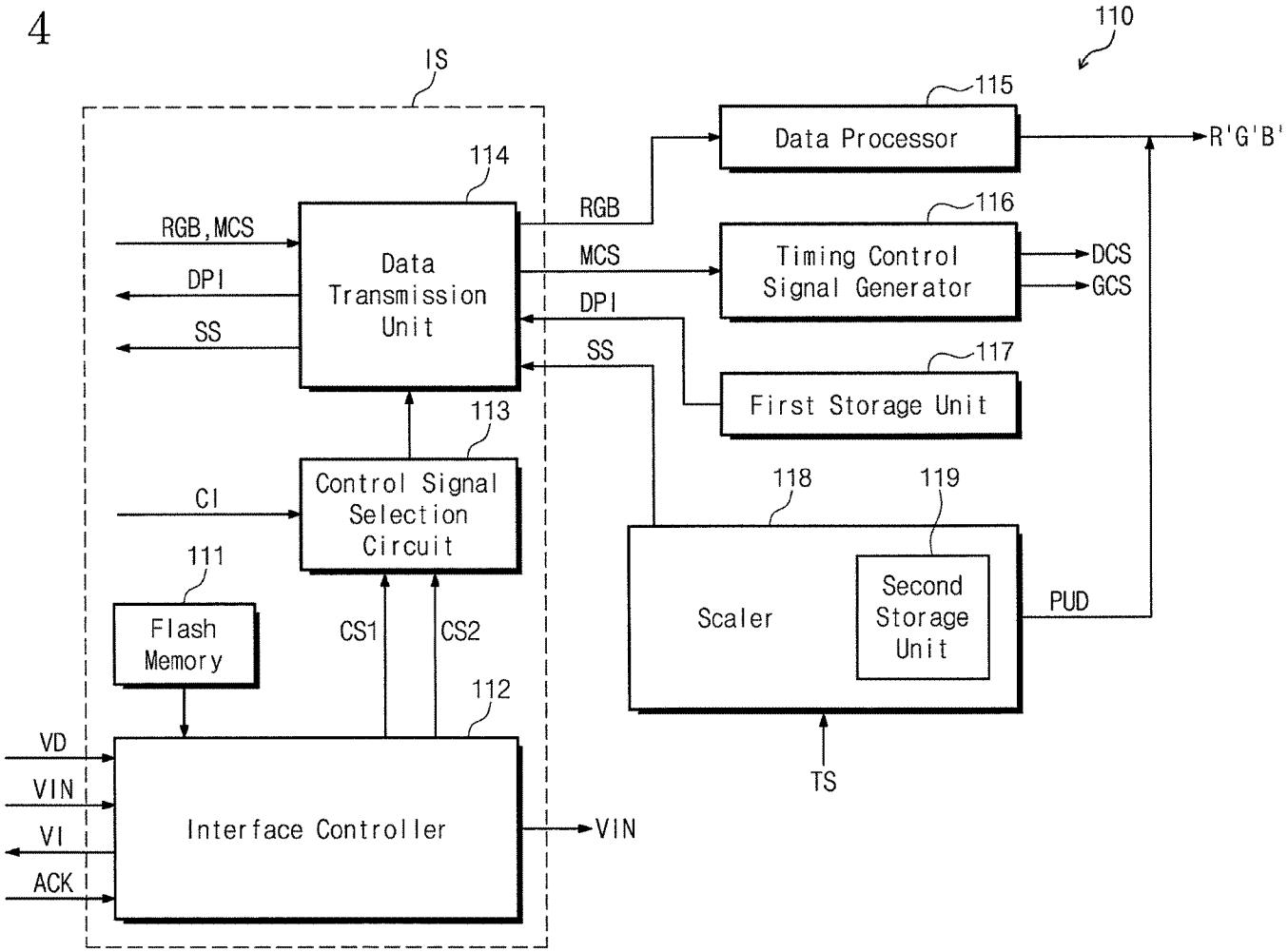
FIG. 4 illustrates an embodiment of a timing controller.
Figure 5:
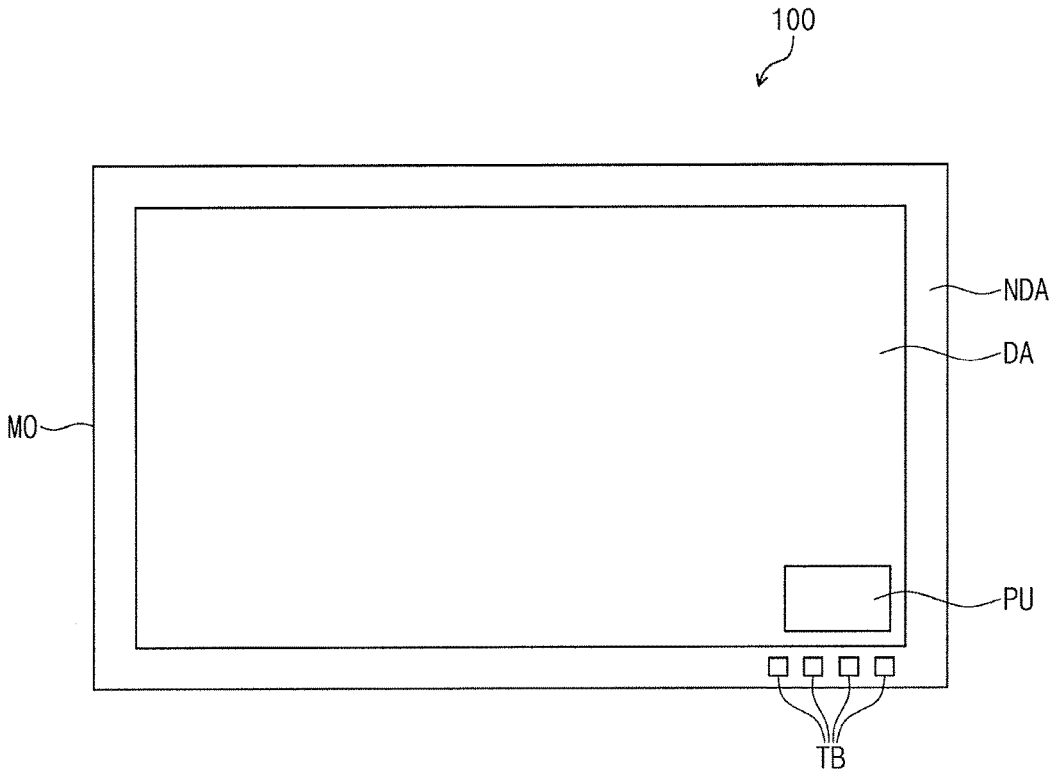
FIG. 5 illustrates an embodiment of a front surface of a display panel.

FIG. 3 illustrates an embodiment of the display device 100 in FIG. 1. FIG. 4 illustrates an embodiment of a timing controller 110 in FIG. 3. FIG. 5 illustrates an embodiment of a front surface of a display panel when a display device 100 is a monitor.

Referring to FIGS. 3, 4, and 5, the display device 100 includes the timing controller 120, a display unit 120 for displaying an image based on control of the timing controller 110, and a DC/DC converter 130 for providing voltages for operating the display unit 120. The host 200 transmits an operation voltage VD, an input voltage VIN, image signals RGB, and a main control signal MCS to the timing controller 110 of the display device 100 through the USB cable 10.

The timing controller 110 of the display device 100 is connected to the first connector 12 of the USB cable 10 and receives the operation voltage VD, the input voltage VIN, the image signals RGB, and the main control signal MCS from the host 200 through the USB cable 10. The timing controller 110 provides the image signals RGB to the display unit 120 and controls the display unit 120 to display an image corresponding to the image signals RGB based on the main control signal MCS.

The timing controller 110 includes an interface system IS, a data processor 115, a timing control signal generator 116, a first storage unit 117, and a scaler 118. The scaler 118 includes a second storage unit 119. The interface system IS may receive power from the host 200 through the USB cable 10 and control the transmission of signals from the host 200 through the USB cable 10.

The interface system IS includes a flash memory 111, an interface controller 112, a control signal selection circuit 113, and a data transmission unit 114. The interface controller 112 may be a Universal Serial Bus (USB) controller.

A control program for controlling the interface controller 112 is stored in the flash memory 111. The control program may include firmware to control operation of the interface controller 112, that is hardware.

The operation voltage VD may be a voltage for operating the interface controller 112. The operation voltage VD may be provided to the interface controller 112 of the timing controller 110 when the display device 100 is connected to the host 200 through the USB cable 10. The interface controller 112 may operate based on the operation voltage VD from the host 200. The operation voltage VD may be a predetermined voltage, e.g., 5V.

The interface controller 112 requests the host 200 for a voltage for operating the display unit 120. For example, the interface controller 112 transmits voltage information VI for operation of the display unit 120 to the host 200 through the USB cable 10. The host 200 receives the voltage information VI and transmits a reception notification signal ACK and an input voltage VIN for operation of the display unit 120 to the interface controller 112 of the timing controller 110.

Qhen receiving the voltage information VI, the host 200 determines whether a voltage corresponding to the voltage information VI is a voltage supported by the host 200. When the voltage corresponding to the voltage information VI is a voltage supported by the host 200, the host 200 provides the input voltage VIN to the interface controller 112 with the reception notification signal ACK. The input voltage VIN may be a predetermined voltage, e.g., 12V. The interface controller 112 provides the input voltage VIN from the host 200 to the DC/DC converter 130.

The DC/DC converter 130 may generate a plurality of voltages for the display unit 120 based on the input voltage VIN. For example, the DC/DC converter 130 may generate an analog voltage AVDD, a gate on voltage VON, a gate off voltage VOFF, a common voltage VCOM, and a light source voltage VLED based on the input voltage VIN. The analog voltage AVDD, the gate on voltage VON, the gate off voltage VOFF, the common voltage VCOM, and the light source voltage VLED may be provided for operation of the display unit 120.

The display unit 120 may operate and display an image based on the analog voltage AVDD, the gate on voltage VON, the gate off voltage VOFF, the common voltage VCOM, and the light source voltage VLED from the DC/DC converter 130.

The interface controller 112 provides control signals for controlling the output order of the image signals RGB according to the position of the first connector 12 to the control signal selection circuit 113. The output operation of the data transmission unit 114, which determines the output order of the image signals RGB, may be controlled by the control signals.

The control signals may include a first control signal CS1 and a second control signal CS2. The first control signal CS1 controls an output operation for the image signals RGB of the data transmission unit 114 when the first connector 12 is connected to the display device 100 in the first position. The second control signal CS2 controls an output operation for the image signals RGB of the data transmission unit 114 when the first connector 12 is connected to the display device 100 in the reverse position.

The host 200 provides information on the connection position of the first connector 12 to the control signal selection circuit 113 of the timing controller 110. The control signal selection circuit 113 outputs one of the first or second control signals CS1 and CS2 based on the information on the connection position of the first connector 12, which is provided according to the connection position of the first connector 12.

In one embodiment, the display device 100 may include first and second connection terminals to be connected to the first and second pins PIN1 and PIN2 of the first connector 12. The first and second connection terminals may be connected to the timing controller 110. When the first connector 12 is connected to the display device 100 in the first position, the first pins PIN1 are connected to the first connection terminals and the second pins PIN2 are connected to the second connection terminals. When the first connector 12 is connected to the display device 100 in the reverse position, the first pins PIN1 are connected to the second connection terminals and the second pins PIN2 are connected to the first connection terminals.

The host 200 may output a predetermined signal as connector connection information CI. The connector connection information CI may be transmitted to the display device 100 through at least one of the first pins PIN1. At least one first pin (PIN1) for transmitting the connector connection information CI may be connected to at least one first connection terminal of the first connection terminals. When the connector connection information CI is provided to the control signal selection circuit 113, the control signal selection circuit 113 determines the connection state of the first connector 12 as the first position.

At least one first pin (PIN1) for transmitting the connector connection information CI may be connected to at least one second connection terminal of the second connection terminals. When the connector connection information CI is provided to the control signal selection circuit 113, the control signal selection circuit 113 determines the connection state of the first connector 12 as the reverse position.

When the first connector 12 is connected to the display device 100 in the first position, the control signal selection circuit 113 outputs the first control signal CS1, based on the connector connection information CI, for input into the data transmission unit 114. When the first connector 12 is connected to the display device 100 in the reverse position, the control signal selection circuit 113 outputs the second control signal CS2, based on the connector connection information CI, for input into the data transmission unit 114.

The data transmission unit 114 receives the image signals RGB and the main control signal MCS from the host 200 through the USB cable 10. When the connection state of the first connector 12 is in the first position, the data transmission unit 114 sequentially outputs the image signals RGB in response to the first control signal CS1. For example, the image signals RGB may include first to fourth image signals. When the connection state of the first connector 12 is in the first position, the data transmission unit 114 may receive the image signals RGB through the first connector 12 in the order of the first image signal, the second image signal, the third image signal, and the fourth image signal.

The data transmission unit 114 outputs the image signals RGB in the order in which they are received based on the first control signal CS1. For example, the data transmission unit 114 outputs the image signals RGB in the order of the first image signal, the second image signal, the third image signal, and the fourth image signal based on the first control signal CS1.

When the connection state of the first connector 12 is in the reverse position, the image signals RGB may be provided to the data transmission unit 114 differently from the case that the connection state of the first connector 12 is in the first position. For example, when the connection state of the first connector 12 is in the reverse position, the image signals RGB may be provided to the data transmission unit 114 through the first connector 12 in the order of the fourth image signal, the third image signal, the second image signal, and the first image signal.

Based on the second control signal CS2, the data transmission unit 114 changes the order of image signals to be the same as the order in which the connection state of the first connector 12 is in the first position. The image signals are then output. For example, when the connection state of the first connector 12 is in the reverse position, based on the second control signal CS2, the image signals RGB received in the order of the fourth image signal, the third image signal, the second image signal, and the first image signal are changed to the order of the first image signal, the second image signal, the third image signal, and the fourth image signal, and then are output.

The data transmission unit 114 provides the image signals RGB to the data processor 115 and provides the main control signal MCS to the timing control signal generator 116. The data processor 115 converts the data format of the image signals RGB from the data transmission unit 114 to match the interface specification with the data driver of the display unit 120. The data processor 115 provides the data format-converted image signals R'G'B' to the display unit 120.

The timing control signal generator 116 generates timing control signals for controlling the operation timing of the display unit 120 based on the main control signal MCS from the data transmission unit 114. In one embodiment, the timing control signals include a gate control signal GCS and a data control signal DCS. These control signals are provided to the display unit 120, and the display unit 120 displays an image corresponding to the image signals R'G'B based on the gate control signal GCS and the data control signal DCS.

In one embodiment, the main control signal MCS may include a vertical synchronization signal that is a frame distinction signal, a horizontal synchronization signal that is a row distinction signal, a data enable signal that is at a first (e.g., high) level during only a section where data is output for displaying a zone where data is input, and a main clock signal.

The first storage unit 117 stores information DPI on the specifications (e.g., display panel specification information) of the display unit 120. For example, the specification of the display unit 120 may include a specification for the display panel of the display unit 120 for displaying an image and, for example, may be the specification of a monitor. The display panel specification information DPI may include information such as but not limited to the resolution and color gamut of a display panel.

The display panel specification information DPI stored in the first storage unit 117 is provided to the data transmission unit 114. The data transmission unit 114 transmits the display panel specification information DPI to the host (200) through the USB cable 10. The host 200 provides the image signals RGB corresponding to the display panel specification and the main control signal MCS to the display device 100 through the USB cable 10. The host 200 may include a host interface controller for controlling the transmission of signals to be provided to the display device 100.

The scaler 118 may provide an on screen display (OSD) function to a user. For example, in FIG. 5, the display device 100 may be a monitor MO and the plane area of the monitor MO includes a display area DA for displaying an image and a non display area NDA surrounding the display area DA. The non display area NDA may, for example, be printed with a predetermined color.

A plurality of touch buttons TB for adjusting the brightness, color, size, and position of the monitor MO may be at a predetermined (e.g., right lower) end of the monitor MO in a predetermined area of the non display area NDA. The touch buttons TB may be implemented in a touch manner and may be operated by a user touch. A user may operate the touch buttons TB to adjust the brightness, color, size, and position of the display area DA of the monitor MO.

Adjustment of the brightness and color of the display area DA may be performed by adjusting the brightness and color of an image in the display area DA. The adjustment of the size and position of the display area DA is performed as the overall size of the display area DA is adjusted, or the position of the display area DA is adjusted vertically and horizontally when the size of the display area DA is fixed.

When a user operates the touch buttons TB, a pop-up window PU may be displayed in a predetermined area at the right lower end of the display area DA of the monitor MO. The brightness, color, size, and position state information of the display area DA of the monitor MO may be displayed to a user through the pop-up window PU.

In one embodiment, the pop-up data PUD for displaying the pop-up window PU displayed on the monitor MO may not be provided from the host 200 to the display device 100, but may be stored in the second storage 119 of the scaler 118. When a user touches the touch buttons TB, the pop-up data PUD stored in the second storage unit 119 is provided to the display unit 120 together with the image signals R'G'B'. The display unit 120 may display the pop-up window PU based on the pop-up data PUD.

When a user operates the touch buttons TB for adjusting the brightness, color, size, or position of the display area DA of the monitor MO, the touch signal TS is provided to scaler 118. The scaler 118 provides a screen control signal SS corresponding to the touch signal TS to the data transmission unit 114.

The data transmission unit 114 outputs a screen control signal SS and the screen control signal SS is provided to the host 200 through the USB cable 10. The host 200 provides the image signals RGB that a user requests to change and the main control signal MCS for controlling the display of the image signals RGB to the display device 100 through the USB cable 10 based on the screen control signal SS. For example, when a user operates the touch buttons TB to adjust the brightness of the display area DA of the monitor MO, a touch signal TS for adjusting the brightness of the display area DA of the monitor MO is provided to scaler 118. The scaler 118 provides the screen control signal SS for changing the brightness of the display area DA of the monitor MO to the data transmission unit 114 in response to the touch signal TS.

The data transmission unit 114 outputs the screen control signal SS for changing the brightness of the display area DA of the monitor MO to the host 200 through the USB cable 10. The host 200 provides the brightness-changed image signals RGB and the main control signal MCS for controlling the display of the brightness-changed image signals RGB to the display device 100 through the USB cable 10. Accordingly, the display device 100 may display the brightness-changed image signals RGB based on the main control signal MCS.

As described above, the brightness-changed image signals RGB are provided to the data processor 115 through the data transmission unit 114 and the data format of the brightness-changed image signals RGB is converted by the data processor 115 and provided to the display unit 120. The main control signal MCS for controlling the display of the brightness-changed image signals RGB is provided to the timing control signal generator 116 through the data transmission unit 114. The timing control signal generator 116 generates the data control signal DCS and the gate control signal GCS and provides these signals to the display unit 120.

In the present embodiment, the interface system IS and the scaler 118 are not manufactured with separate chips and are not disposed separately from the timing controller 110. For example, the interface system IS and the scaler 118 are built in the timing controller 110, so that they are implemented as one chip together with the timing controller 110. Therefore, manufacturing costs may reduced compared to the case where a plurality of chips are manufactured. Also, power consumption may be reduced compared to a case where a plurality of chips are driven.

Figure 6:
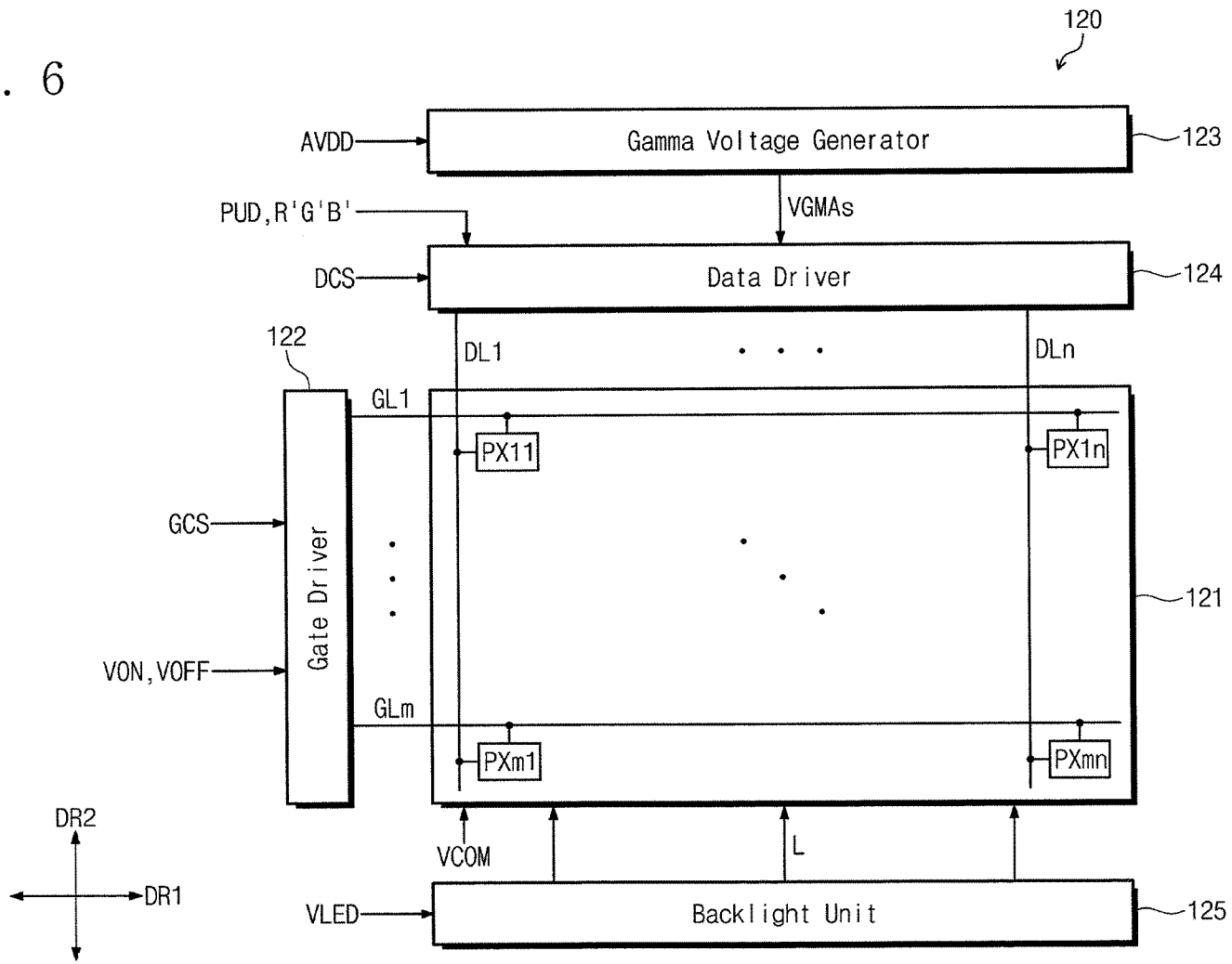
FIG. 6 illustrates an embodiment of a display unit.

FIG. 6 illustrates an embodiment of the display unit 120 in FIG. 3. Referring to FIG. 6, the display unit 120 includes a display panel 121, a gate driver 122, a gamma voltage generator 123, a data driver 124, and a backlight unit 125. The display panel 121 may be a liquid crystal display panel that includes a liquid crystal layer between two substrates.

The display panel 121 includes a plurality of gate lines GL1 to GLm, a plurality of data lines DL1 to DLn, and a plurality of pixels PX11 to PXmn, where m and n are natural numbers. The gate lines GL1 to GLm may extend in a first direction DR1 and may be connected to the gate driver 122. The data lines DL1 to DLn may extend in a second direction DR2 intersecting the first direction DR1 and may be connected to the data driver 124.

The pixels PX11 to PXmn are arranged in areas where the gate lines GL1 to GLm and data lines DL1 to DLn intersect. The pixels PX11 to PXmn may be arranged in a matrix and connected to the gate lines GL1 to GLm and the data lines DL1 to DLn. The pixels PX11 to PXmn may display light of predetermined combination of colors, e.g., red, green, or blue color. In another embodiment, the pixels PX11 to PXmn may output light of a different combination of colors, including but not limited to white, yellow, cyan, and magenta.

The common voltage VCOM generated by the DC/DC converter 130 is provided to the display panel 121 and the gate on and off voltages VON and VOFF are provided to the gate driver 122. The analog voltage AVDD generated by the DC/DC converter 130 is provided to the gamma voltage generator 123 and the light source voltage VLED is provided to the backlight unit 125.

The timing controller 110 may be mounted on a printed circuit board in the form of an integrated circuit chip and connected to the gate driver 122 and the data driver 124. The gate control signal GCS generated by the timing control signal generator 116 of the timing controller 110 is provided to the gate driver 122 and the data control signal DCS is provided to the data driver 124.

The gate control signal GCS is a control signal for controlling operation timing of the gate driver 122. The data control signal DCS is a control signal for controlling operation timing of the data driver 124.

The gate driver 122 generates gate signals based on the gate control signal GCS. When generating gate signals, the gate driver 122 determines the high level of the gate signals based on the gate on voltage VON and determines the low level of the gate signals based on the gate off voltage VOFF. The gate signals may be output sequentially to the pixels PX11 to PXnm through the gate lines GL1 to GLm.

The image signals R'G'B' output from the data processor 115 of the timing controller 110 are provided to the data driver 124. In addition, when a user touches the touch buttons TB, the pop-up data PUD stored in the second storage unit 119 of the scaler 118 may be provided to the data driver 124.

The gamma voltage generator 123 generates a plurality of gamma voltages VGMAs based on the analog voltage supplied from the DC/DC converter 130, and provides the generated gamma voltages VGMAs to the data driver 124.

The data driver 124 generates data voltages in an analog form corresponding to the image signals R'G'B' based on the data control signals DCS. The data driver 124 converts the image signals R'G'B' to data voltages in an analog form based on the gamma voltages VGMAs from the gamma voltage generator 123. The data voltages are provided to the pixels PX11 to PXnm through the data lines DL1 to DLn.

When a user touches the touch buttons TB, the pop-up data PUD provided to the data driver 124 may also be converted to data voltages in an analog form by the data driver 124 for input to the pixels PX11 to PXmn through the data lines DL1 to DLn.

The gate driver 122 and the data driver 124 may be formed of a plurality of driving chips mounted on a flexible printed circuit board and may be connected to the display panel 121, for example, through a Tape Carrier Package (TCP) method. In one embodiment, the gate driver 122 and the data driver 124 may be formed of a plurality of driving chips mounted on the display panel 121 through a Chip on Glass (COG) method.

In addition, the gate driver 122 may be formed simultaneously with the transistors of the pixels PX11 to PXmn and mounted on the display panel 121 in the form of, for example, an amorphous silicon TFT driver circuit (ASG) or an oxide silicon TFT gate driver circuit (OSG).

The backlight unit 125 is driven by the light source voltage VLED supplied from the DC/DC converter 130 to generate the light L. The backlight unit 125 includes a plurality of light sources driven by the light source voltage VLED to generate the light L. The light sources may include, for example, light emitting diodes or cold cathode fluorescent lamps. The backlight unit 125 is at the rear of the display panel 121, and the light L generated by the backlight unit 125 is provided to the display panel 121.

The pixels PX11 to PXmn receive data voltages through the data lines DL1 to DLn based on gate signals provided through the gate lines GL1 to GLm. An image may be displayed as the pixels PX11 to PXmn emit light having grayscale values corresponding to the data voltages. The pixels PX11 to PXmn driven by the data voltages may display an image by adjusting the transmittance of the light from the backlight unit 125.

Figure 7:
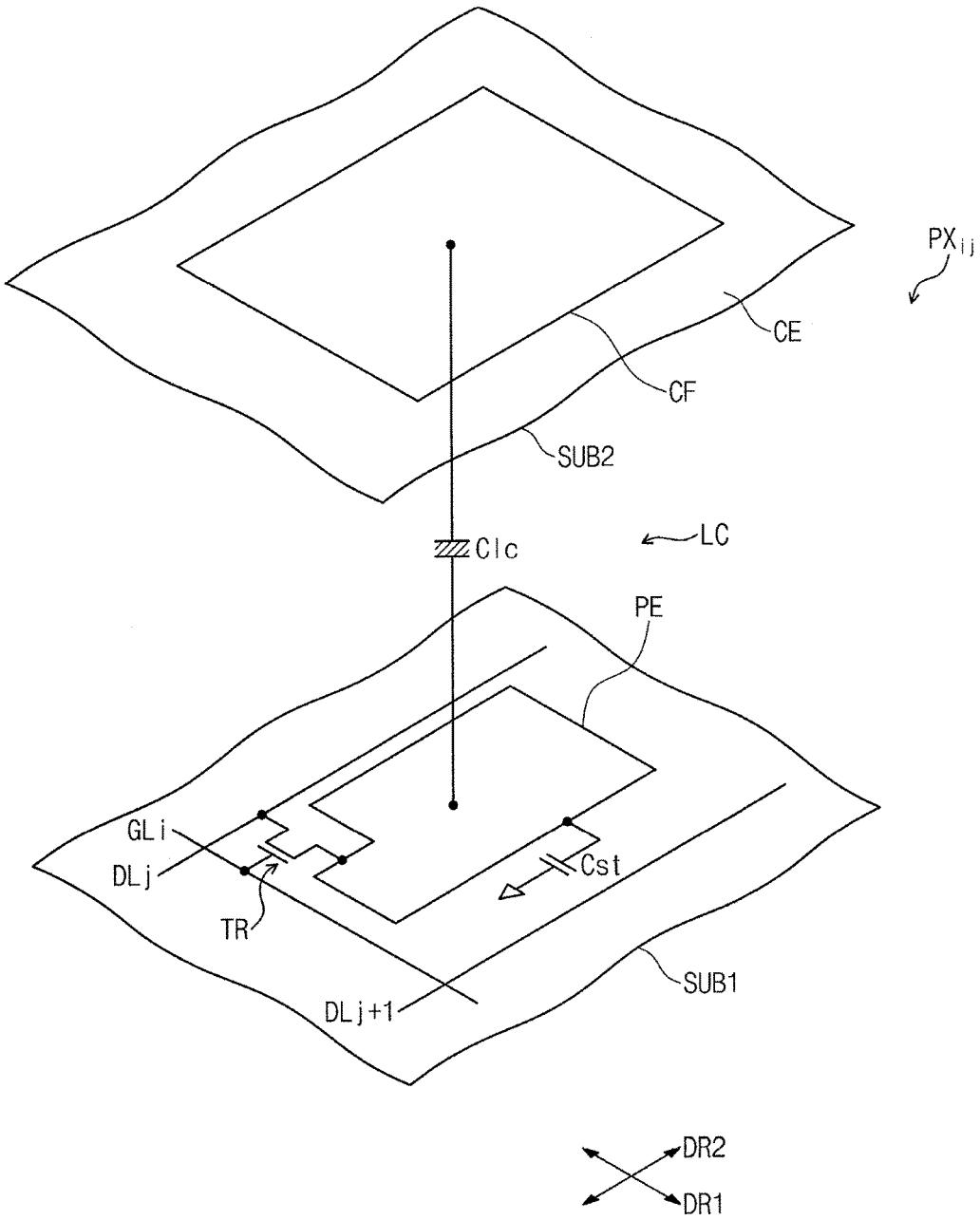
FIG. 7 illustrates an embodiment of a pixel.

FIG. 7 illustrates an embodiment of a pixel PXij which may be representatives of the pixels in the display panel 121 in FIG. 6. The pixel PXij is connected to a gate line GLi and a data line DLj. Referring to FIG. 7, the display panel 121 includes a first substrate SUB1, a second substrate SUB2 facing the first substrate SUB1, and a liquid crystal layer LC between the first substrate SUB1 and the second substrate SUB2.

The pixel PXij includes a transistor TR connected to the gate line GLi and the data line DLj, a liquid crystal capacitor Clc connected to the transistor TR, and a storage capacitor Cst connected in parallel to the liquid crystal capacitor Clc. In one embodiment, the storage capacitor Cst may be omitted. Here, i is a natural number less than or equal to m and j is a natural number less than or equal to n.

The transistor TR may be on the first substrate SUB1 and may include a gate electrode connected to the gate line GLi, a source electrode connected to the data line DLj, and a drain electrode connected to the liquid crystal capacitor Clc and the storage capacitor Cst. The liquid crystal capacitor Clc includes a pixel electrode PE on the first substrate SUB1, a common electrode CE on the second substrate SUB2, and a liquid crystal layer LC between the pixel electrode PE and the common electrode CE. The liquid crystal layer LC serves as a dielectric. The pixel electrode PE is connected to the drain electrode of the transistor TR.

The pixel electrode PE may have a non-slit structure in FIG. 7. In one embodiment, the pixel PE may have a slit structure having a plurality of branch parts extending radially from a cross-shaped branch part.

The common electrode CE may be entirely formed on the second substrate SUB2. In one embodiment, the common electrode CE may be on the first substrate SUB1. In such a case, at least one of the pixel electrode PE and the common electrode CE may include a slit.

The storage capacitor Cst may include a pixel electrode PE, a storage electrode branched from a storage line, and an insulation layer between the pixel electrode PE and the storage electrode. The storage line may be on the first substrate SUB1 and may be formed on the same layer as the gate lines GL1 to GLm. The storage electrode may partially overlap the pixel electrode PE.

The pixel PXij may further include a color filter CF representing, for example, one of red, green, and blue colors. As an exemplary embodiment, as illustrated in FIG. 7, the color filter CF may be on the second substrate SUB2. In one embodiment, and the color filter CF may be on the first substrate SUB1.

The transistor TR is turned on based on the gate signal provided through the gate line GLi. The data voltage is received via the data line DLj and is supplied to the pixel electrode PE of the liquid crystal capacitor Clc through the turned-on transistor TR. A common voltage is applied to the common electrode CE.

An electric field is formed between the pixel electrode PE and the common electrode CE based on a difference in the voltage levels of a data voltage and a common voltage. The liquid crystal molecules of the liquid crystal layer LC are driven by an electric field formed between the pixel electrode PE and the common electrode CE. Light transmittance from the backlight unit 125 is adjusted by liquid crystal molecules driven by the electric field, so that an image may be displayed.

A storage voltage having a constant voltage level may be applied to a storage line. In one embodiment, the storage line may receive the common voltage. The storage capacitor Cst serves to complement the voltage charged in liquid crystal capacitor Clc.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The controllers, converters, selectors, scalers, drivers, generators, processors, units, and other processing features of the disclosed embodiments may be implemented in logic which, for example, may include hardware, software, or both. When implemented at least partially in hardware, the controllers, converters, selectors, scalers, drivers, generators, processors, units, and other processing features may be, for example, any one of a variety of integrated circuits including but not limited to an application-specific integrated circuit, a field-programmable gate array, a combination of logic gates, a system-on-chip, a microprocessor, or another type of processing or control circuit When implemented in at least partially in software, the controllers, converters, selectors, scalers, drivers, generators, processors, units, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

In accordance with one or more of the aforementioned embodiments, an interface system and a scaler are built into a timing controller of a display device, and thus are implemented as one chip together with the timing controller. As a result, manufacturing costs and power consumption may be reduced.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A display device, comprising:

a timing controller, connected to a connector of a USB cable, to receive image signals from a host through the USB cable; and a display to receive the image signals from the timing controller to display an image, wherein the timing controller includes:

an interface controller to output control signals to control an output order of the image signals;

a control signal selector to select and output a control signal corresponding to a connection position of the connector among the control signals from the interface controller;

a data transmitter to determine the output order of the image signals from the host based on the control signal from the control signal selector; and a data processor to receive the image signal from the data transmitter and to provide the received image signal to the display, wherein the timing controller controls operations of the display, and the interface controller, the control signal selector, and the data transmitter are implemented as one chip together with the timing controller.

2. The display device as claimed in claim 1, wherein the interface controller is to receive an operation voltage from the host through the USB cable.

3. The display device as claimed in claim 1, wherein:

the connector is connected to the timing controller in a first position or a reverse position, and the reverse position is an upside-down state of the connector.

4. The display device as claimed in claim 3, wherein:

the image signals are to be provided to the data transmitter in different orders based on whether the connector is connected to the timing controller in the first position or the reverse position.

5. The display device as claimed in claim 4, wherein the control signals include:

a first control signal to control an output operation of the data transmitter when the connector is connected to the timing controller in the first position; and a second control signal to control an output operation of the data transmitter when the connector is connected to the timing controller in the reverse position.

6. The display device as claimed in claim 5, wherein the control signal selector is to output:

the first control signal when the connector is connected to the timing controller in the first position, and the second control signal when the connector is connected to the timing controller in the reverse position.

7. The display device as claimed in claim 6, wherein the control signal selector is to:

receive connector connection information from the host, and output one of the first or second control signals based on the connector connection information received according to a connection position of the connector.

8. The display device as claimed in claim 6, wherein the data transmitter is to output the image signals in an order in which the image signals are received based on the first control signal.

9. The display device as claimed in claim 6, wherein the data transmitter is to change an output order of the image signals to be equal to when the connector is connected to the timing controller in the first position based on the second control signal.

10. The display device as claimed in claim 1, wherein the timing controller is to:

receive a main control signal to control an operation timing of the display from the host through the USB cable, and control the display to display the image based on the main control signal.

11. The display device as claimed in claim 10, wherein the timing controller includes:

a timing control signal generator to generate a data control signal and a gate control signal to control an operation timing of the display based on the main control signal and to provide the data control signal and the gate control signal to the display, wherein the data transmitter is to receive the main control signal from the host through the USB cable and provide the received main control signal to the timing control signal generator.

12. The display device as claimed in claim 11, wherein the display includes:

a display panel includes a plurality of pixels to emit light to display the image;

a gate driver to generate gate signals based on the gate control signal from the timing control signal generator and to provide the gate signals to the pixels; and a data driver to receive the image signals from the data processor, generate data voltages corresponding to the image signals based on the data control signal from the timing control signal generator, and provide the data voltages to the pixels, wherein the data processor is to receive the image signal from the data transmitter, convert the image signal to match an interface specification of the data driver, and provide the converted image signal to the data driver.

13. The display device as claimed in claim 12, wherein the timing controller includes a first storage area to store specification information corresponding to the display panel.

14. The display device as claimed in claim 13, wherein:

the data transmitter is to provide the specification information of the display panel stored in the first storage area to the host through the USB cable, and the host is to provide image signals and a main control signal corresponding to the specification information of the display panel to the data transmitter through the USB cable.

15. The display device as claimed in claim 1, further comprising:

a DC/DC converter to receive an input voltage to generate and output a plurality of voltages to operate the display, wherein the interface controller is to receive the input voltage from the host through the USB cable and provide the received input voltage to the DC/DC converter.

16. The display device as claimed in claim 1, wherein:

the timing controller includes a scaler to output a screen control signal to adjust at least one of a brightness, color, size, or position of a display area where the image is displayed, the data transmitter is to receive the screen control signal and provide the screen control signal to the host through the USB cable, and the host is to provide image signals and a main control signal to adjust at least one of the brightness, color, size, or position of the display area to the data transmitter through the USB cable based on the screen control signal.

17. The display device as claimed in claim 16, wherein the scaler includes:

a second storage area to store pop-up data to display at least one of the brightness, color, size, or position of the display area, and when a user changes at least one of the brightness, color, size, or position of the display area, the display is to receive the pop-up data from the second storage area and display the received pop-up data.

18. A display device, comprising:

a timing controller, connected to a connector of a USB cable, to receive image signals from a host through the USB cable, the connector being connectable in a first connection position and a second connection position, the second connection position being upside-down relative to the first connection position; and a display to receive the image signals from the timing controller to display an image, wherein the timing controller includes:

an interface controller to output first and second control signals;

a control signal selector receiving the first and second control signals from the interface controller, the control signal selector to select and output one of the first control signal or the second control signal depending on whether the connector is connected in the first connection position or the second connection position;

a data transmitter to receive the image signals in a first sequence or a second sequence, and to selectively change the sequence of the image signals of the second sequence when the control signal selector outputs the second control signal; and a data processor to receive the image signals from the data transmitter and to provide the received image signals to the display, wherein the timing controller controls operations of the display, and the interface controller, the control signal selector, and the data transmitter are implemented as one chip together with the timing controller.

19. The display device as claimed in claim 18, wherein the data transmitter is to output the image signals in an output order that is the same the first sequence in which the image signals are received based on the first control signal, and the output order is a reverse order of the second sequence in which the image signals are received based on the second control signal.

* * * * *